US007192301B2

(12) United States Patent
Kuroda et al.

(10) Patent No.: US 7,192,301 B2
(45) Date of Patent: Mar. 20, 2007

(54) ELECTRICAL CONNECTOR

(75) Inventors: Keiji Kuroda, Nishikamo-gun (JP); Ryo Moriwake, Osaka (JP); Kiyoshi Aramoto, Osaka (JP)

(73) Assignee: J.S.T. Mfg. Col, Ltd. (JP)

( * ) Notice: Subject to any disclaimer, the term of this patent is extended or adjusted under 35 U.S.C. 154(b) by 0 days.

(21) Appl. No.: 11/200,623

(22) Filed: Aug. 10, 2005

(65) Prior Publication Data

US 2006/0035522 A1 Feb. 16, 2006

(30) Foreign Application Priority Data

Aug. 11, 2004 (JP) ..... 2004-234606

(51) Int. Cl.
*H01R 12/24* (2006.01)

(52) U.S. Cl. ..... 439/497

(58) Field of Classification Search ..... 439/497, 439/579, 610

See application file for complete search history.

(56) References Cited

U.S. PATENT DOCUMENTS 4,790,775 A * 12/1988 David ..... 439/579

FOREIGN PATENT DOCUMENTS

JP 10-74548 * 3/1998

* cited by examiner

*Primary Examiner*—Javaid H. Nasri
(74) *Attorney, Agent, or Firm*—Osha Liang LLP

(57) ABSTRACT

A connector is provided with a cable retainer which includes thin plate extending in one direction, five projections projecting from the thin plate part, and a ground part projecting from the projections. The cable retainer clips cables by projections plastically deformed by caulking. Furthermore, when the cable retainer is attached to a housing, it is arranged so that the ends of the connect portions of the ground part face the terminals that serve as ground electrodes.

5 Claims, 9 Drawing Sheets

2a: first terminal

2b: second terminal

ELECTRICAL CONNECTOR

BACKGROUND OF THE INVENTION

1. Field of the Invention

The present invention relates to a connector and a cable retainer to which a cable with a shield material is connected.

2. Description of Related Art

In order to realize higher speed signal processing, high-frequency signals have been propagated in a device or between devices. Some cables preferable for propagating high-frequency signals include a signal wire for propagating high-frequency signals and a conductive shield material enclosing the outer circumference of the signal wire. By grounding the shield material, high-frequency signals propagating in the signal wire can be protected from noises. A technique (refer to Japanese Published Unexamined Patent Application No. H11-260439) is known in that, in a connector to which a shield material-attached cable is connected, the shield material is exposed to the outer circumference of the cable, and the exposed shield material is clipped by a conductive terminal, whereby the shield material and the terminal are electrically connected. According to this technique, the shield material can be grounded by grounding the terminal, the terminal processing of the shield material can be simplified.

However, in the above-described technique, when a signal electrode and the shield material are electrically connected, troublesome wiring operations are necessary in that the terminal that clips the shield material and one end of an electrical wire are electrically connected and the signal electrode and the other end of the electrical wire are electrically joined to each other.

SUMMARY OF THE INVENTION

A main object of the invention is to provide a connector and a cable retainer which can easily electrically connect a cable shield material and an electrode as a connection destination.

The connector of the invention includes a conductive cable retainer having a plate-shaped main part, a first projection projecting from the main part and a second projection projecting from the main part of the first projection, a supporter that supports the cable retainer, a first terminal that is supported by the supporter, a core of a cable retained by the cable retainer being joined to the first terminal, and a second terminal that is supported by the supporter, the second projection of the cable retainer being joined to the second terminal thereto.

In another respect, the cable retainer of the invention includes a plate-shaped main part, first projection projecting from the main part, and a second projection projecting from the main part or the first projection.

According to the invention, a shield material of the cable and the second terminal can be electrically connected by an easy method in that the shield material and the first projection are electrically connected and the second projection and the second terminal (electrode) are electrically connected. Therefore, the troublesome wiring operations for electrically connecting the shield material and the second terminal become unnecessary. Accordingly, harness manufacturing costs can be reduced.

In addition, according to the invention, it is preferable that the first projection is plastically deformed by caulking to clip the cable disposed on the main part between the first projection and the main part. Thereby, various types of the cable with different diameters can be securely retained.

Furthermore, according to the invention, it is preferable that the supporter is in contact with the cable retainer and includes a conductive shell that encloses the joint between the cable core and the first terminal. Thereby, the core exposed from the shield material can be shielded.

In addition, according to the invention, it is also allowed that a plurality of cable retainers as described above are provided. Thereby, a plurality of cables can be retained.

Furthermore, according to the invention, it is preferable that the second projection is separable from the main part or the first projection. This adapts to a case where the shield material and the electrode do not need to be electrically connected.

BRIEF DESCRIPTION OF THE DRAWINGS

Other and further objects, features and advantages of the invention will appear more fully from the following description taken in connection with the accompanying drawings in which:

FIG. 1 is a perspective view of a connector as an embodiment of the invention and the opposing connector to which said connector is inserted into and extracted from;

DESCRIPTION OF THE PREFERRED EMBODIMENTS

Hereinafter, a connector according to a preferred embodiment of the invention is described with reference to the drawings.

Figure 1:
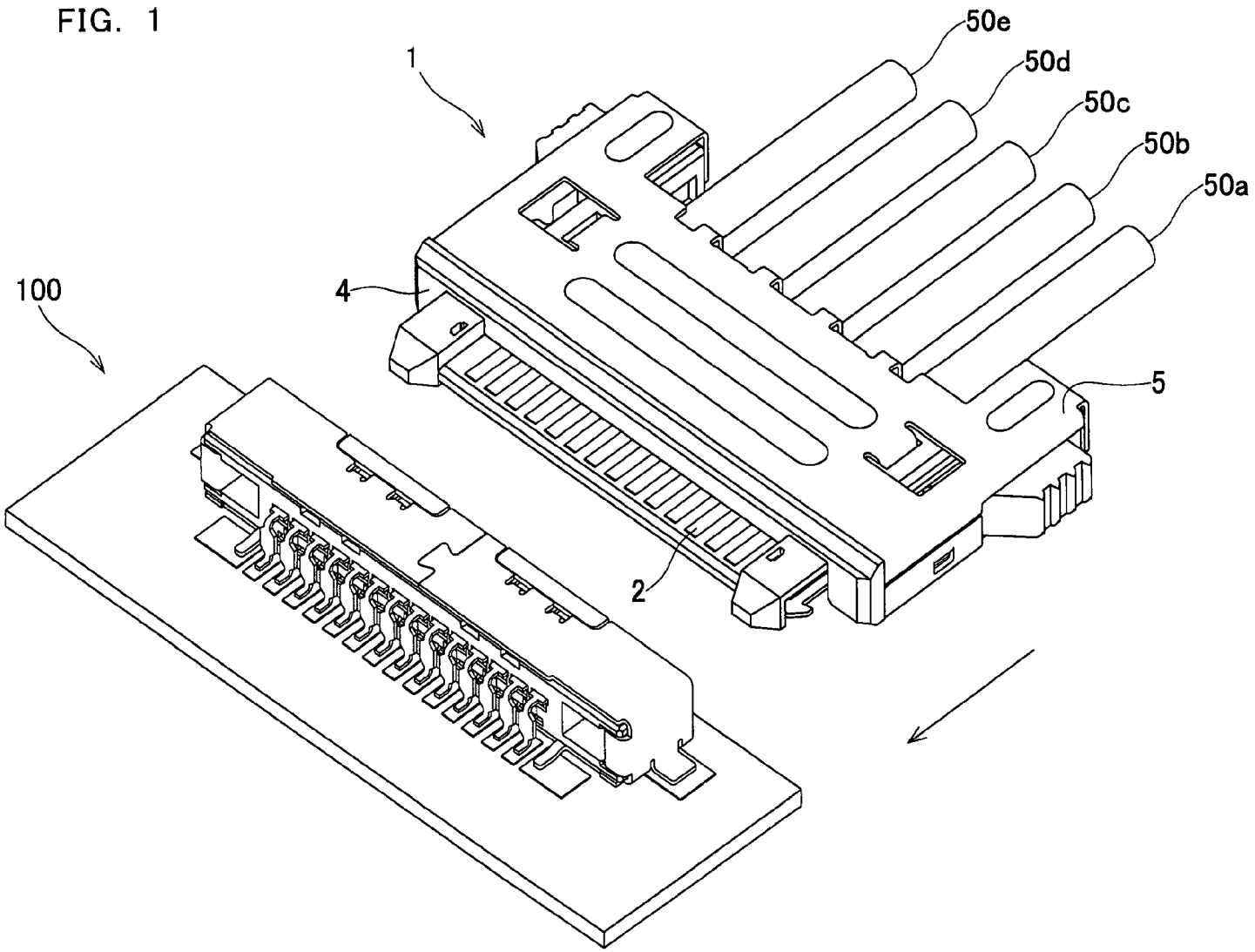
Figure 2:
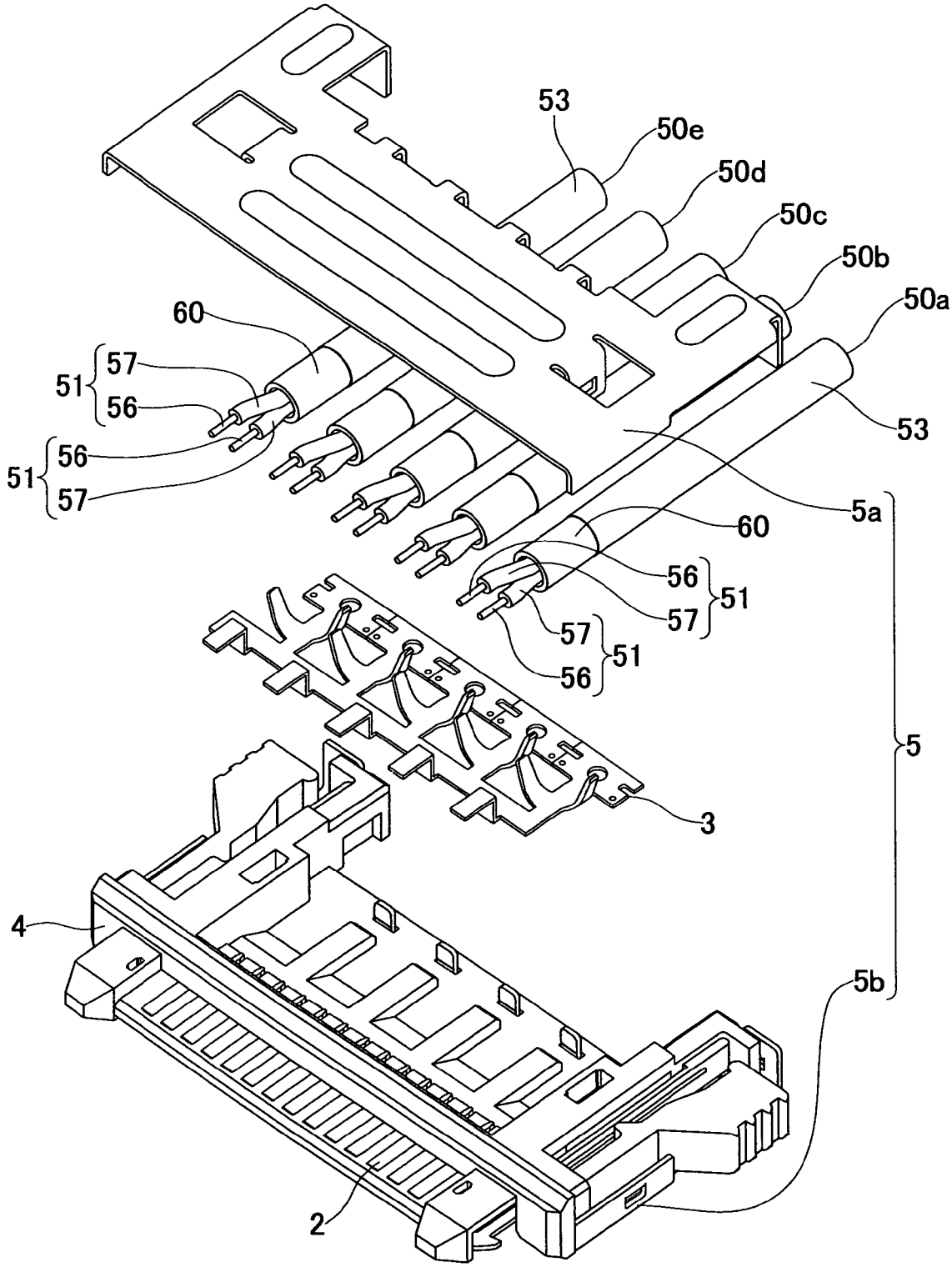
FIGS. 2 and 2A are exploded perspective views of the connector of FIG. 1.
Figure 2A:
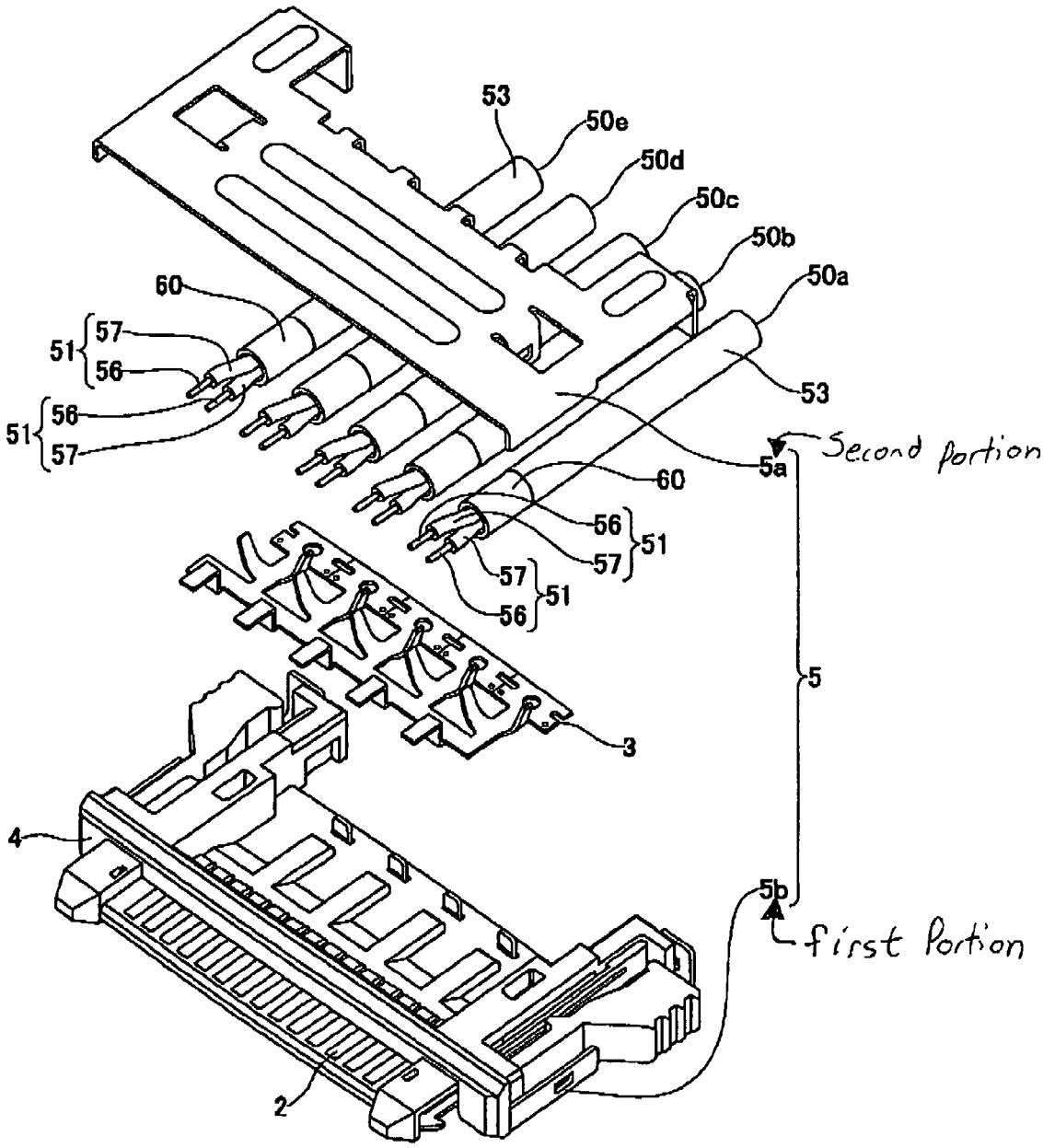

FIG. 1 is a perspective view of a connector according to a preferred embodiment of the invention and the opposing connector which said connector is inserted into and extracted from. The arrow in the figure indicates the inserting direction of the connector 1 into the opposing connector 100. FIG. 2 is an exploded perspective view of the connector 1. As shown in FIG. 1, to the connector 1, five cables 50*a* through 50*e* are connected, and the connector can be inserted into and extracted from the opposing connector 100. The connector 1 includes fourteen terminals (first terminals and second terminals) 2 that are aligned at a predetermined pitch in a direction orthogonal to the inserting direction of the connector 1, a cable retainer 3, and a housing (supporter) 4.

Figure 7:
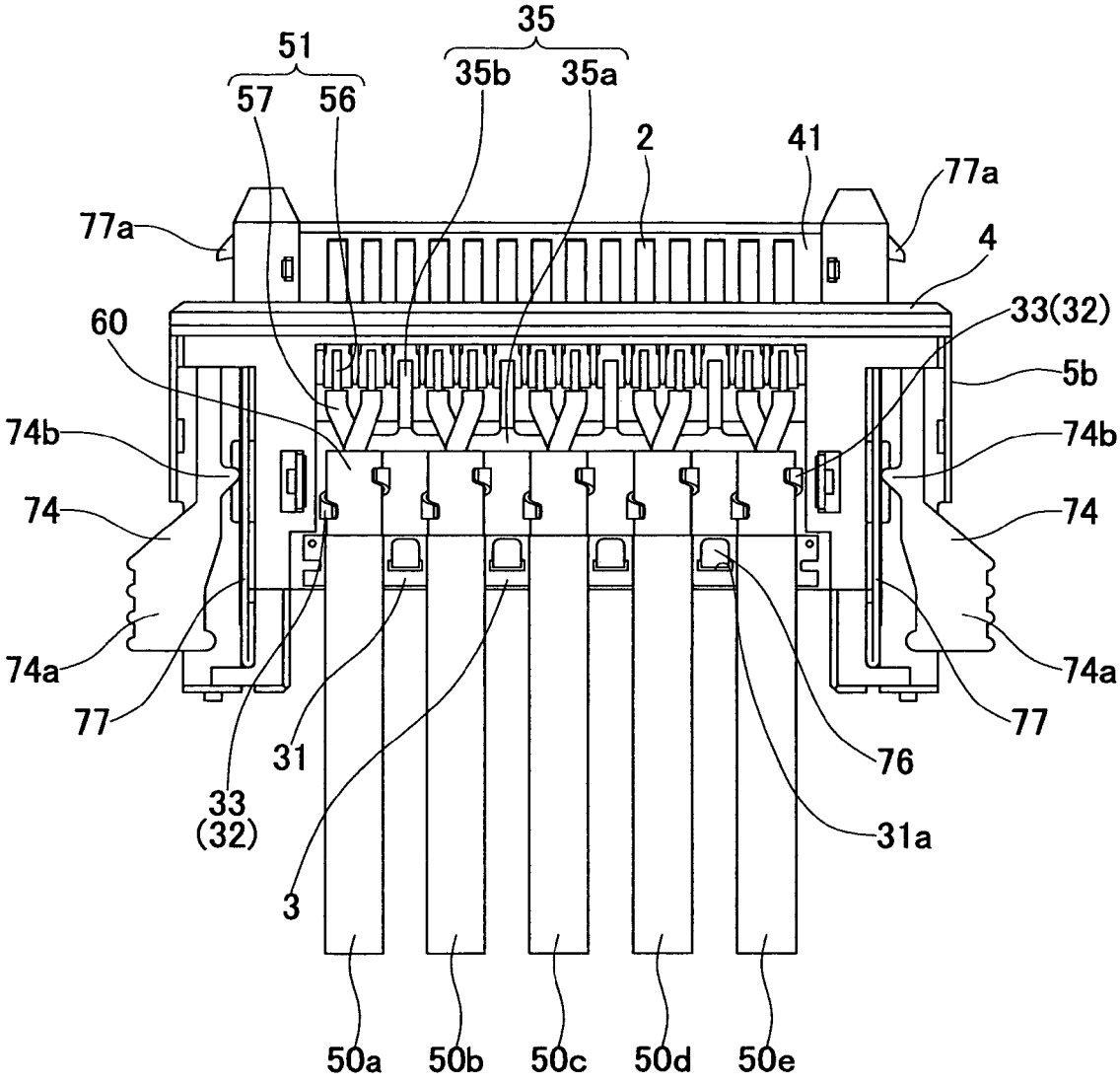
FIGS. 7 and 7A are views for explaining assembling procedures of the connector shown in FIG. 1.
Figure 7A:
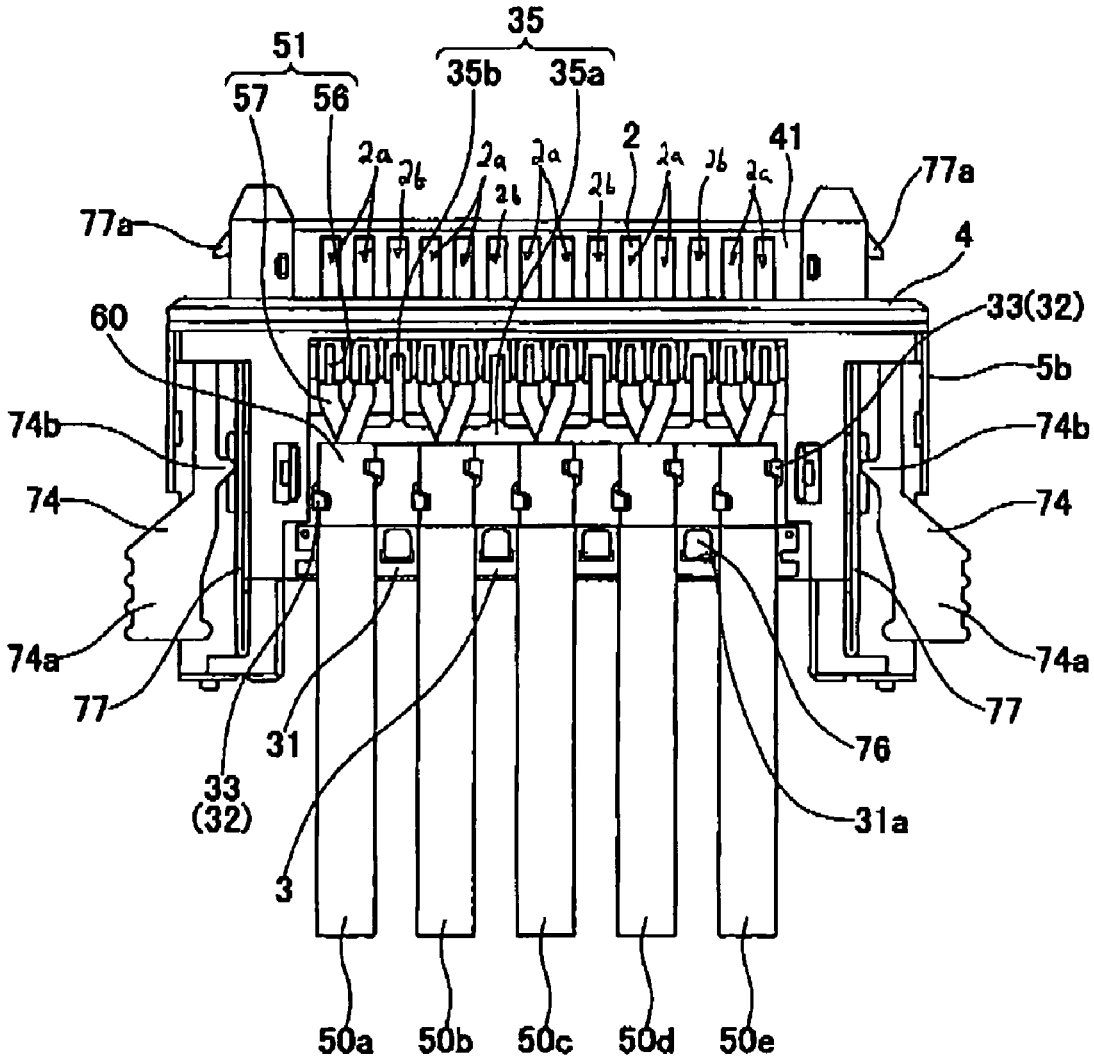

As shown in FIG. 2, the terminals 2 are thin plate-shaped electrodes extending along the inserting direction of the connector 1, and are electrically connected at their front ends to the opposing electrodes of the opposing connector 100, and are electrically connected at their rear ends to cables 50*a* through 50*e* by means of solder joining (see FIG. 7). The cable retainer 3 is a metal-made member for retaining the cables 50*a* through 50*e*. The housing 4 supports the terminals 2 and the cable retainer 3.

The cables 50*a* through 50*e* include two signal wires 51, a shield material 60 covering the outer circumferences of the two signal wires 51, and a jacket 53 covering the outer circumference of the shield material 60. The signal wire 51 includes a core 56 and a jacket 57 covering the outer circumference of the core 56. In the cables 50*a* through 50*e* to be connected to the connector 1, at the ends of connection to the terminals 2, the shield materials 60 are exposed from the jackets 53 and the ends of the signal wires 51 are exposed from the ends of the exposed shield materials 60. At further ends of the exposed signal wires 51, the ends of the cores 56 are exposed from the jackets 57.

Figure 3A:
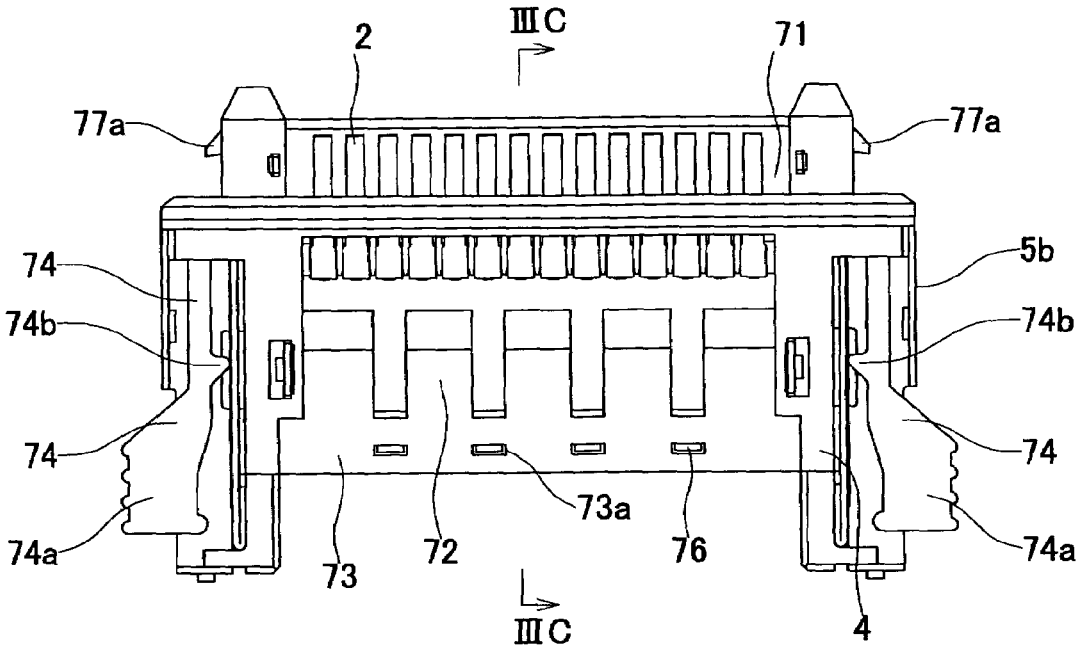
FIG. 3A is a view of the housing shown in FIG. 2 from above.
Figure 3B:
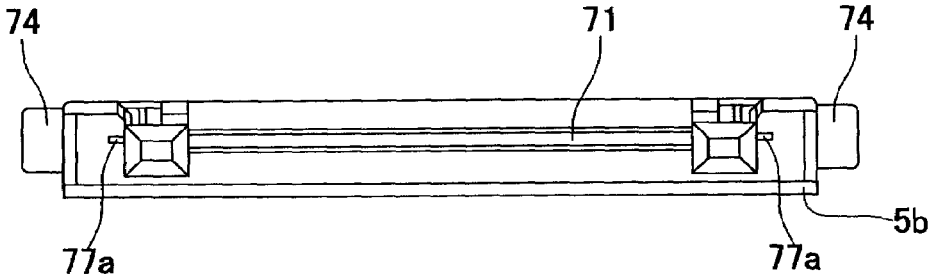
FIG. 3B is a front view of the housing shown in FIG. 2.
Figure 3C:
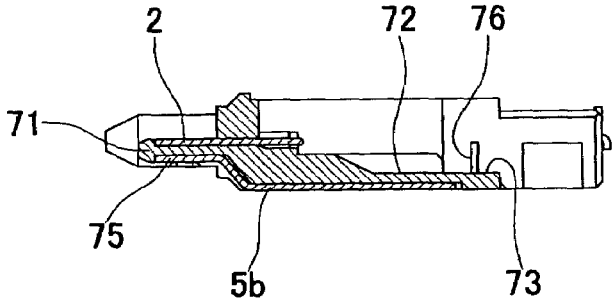
FIG. 3C is a sectional view of the housing along the IIIC—IIIC line of FIG. 3A.

Next, the housing 4 is described in detail with reference to FIG. 3A, FIG. 3B, and FIG. 3C. FIG. 3A is a view of the housing 4 from above. FIG. 3B is a front view of the housing 4. FIG. 3C is a sectional view of the housing 4 along the IIIC—IIIC line of FIG. 3A. From the housing 4 shown in the figures, an upper shell 5*a* that will be described later is removed. The main body part of the housing 4 is formed from a resin as an insulator, and the housing includes a terminal supporting part 71, five concave portions 72, a concave portion 73, two displacing pieces 74, and a shell 5.

As shown in FIG. 3A and FIG. 3B, the terminal supporting part 71 extends along the aligning direction of the terminals 2 and supports the terminals 2 at the front ends of the housing 4, and supports the terminals 2 on the surface so that the extending direction of the terminals 2 is along the inserting direction of the connector 1 and the terminals align in parallel to each other along the longitudinal direction.

The concave portions 72 support the ends of the cables 50*a* through 50*e* and a part of the cable retainer 3, and are formed so as to be adjacent to each other on the rear ends of the terminal supporting part 71 and extend along the inserting direction of the connector 1. The concave portions 72 have roughly rectangular shapes extending in one direction when they are viewed from above, and the widths of the short sides thereof are slightly wider than the widths of the cables 50*a* through 50*e*. When the cables 50*a* through 50*e* are connected to the connector 1, a part of the cable retainer 3 and the ends of the cables 50*a* through 50*e* are disposed within the concave portions 72.

The concave portion 73 supports the cable retainer 3 integrally with the five concave portions 72, and is formed so as to communicate with the five concave portions 72 while extending in the aligning direction of the terminals 2 at the rear ends of the concave portion 72. The bottom of the concave portion 73 has a rectangular shape, and four holes 73*a* with rectangular openings are formed so as to align along the extending direction of the concave portion. As shown in FIG. 3C, when the lower shell 5*b* is attached to the housing 4, a bent portion 76, described later, of the lower shell 5*b* penetrates the hole 73*a* and projects perpendicularly to the bottom of the concave portion 73.

The two displacing pieces 74 are to be pinched by a user when he/she inserts or extracts the connector 1 into or from the opposing connector 100, and as shown in FIG. 3A, the displacing pieces extend along the shorter side of the housing 4 at both longitudinal ends of the housing 4. The displacing pieces 74 have front ends fixed integrally with the side of the housing 4, and free rear ends. At the rear ends of the displacing pieces 74, swelling portions 74*a* that swell to the outside of the housing 4 are formed, and at the middle portions of the displacing pieces, projections 74*b* projecting inwardly are formed. On the outer surfaces of the swelling portions 74*a*, grooves are formed. As described later, a user pinches the two swelling portions 74*a*, whereby the displacing pieces 74 elastically deform. Thereby, the projections 74*b* displace inwardly.

Referring to FIG. 2 again, the shell 5 is a metal-made member having a rectangular shell shape disposed so as to cover the terminals 2 and the ends of the cables 50*a* through 50*e* that are electrically connected to the terminals 2, and the shell includes an upper shell 5*a* disposed on the upper half of the connector 1 and a lower shell 5*b* disposed on the lower half of the connector 1. The upper shell 5*a* and the lower shell 5*b* are formed so as to be separable from each other. The upper shell 5*a* is formed by integral molding of one metal thin plate, and its section orthogonal to the inserting direction of the connector 1 is C-shaped.

The lower shell 5*b* is formed by integral molding of one metal thin plate, and its section orthogonal to the inserting direction of the connector 1 is C-shaped. Then, both ends of the upper shell 5*a* and both ends of the lower shell 5*b* are connected so as to face each other, whereby the shell 5 with a rectangular shell shape is formed. In addition, as shown in FIG. 3A and FIG. 3C, the lower shell 5*b* has an electrode part 75, four bent portions 76, and two latch pieces 77.

The electrode part 75 is electrically connected to a ground electrode of the opposing connector 100 when the connector 1 is inserted into the opposing connector 100, and extends in the inserting direction and has a rectangular shape. The electrode part 75 is disposed so as to be in close contact with the surface opposite the surface supporting the terminals 2 at the terminal supporting part 71 of the housing 4.

The bent portions 76 engage with the cable retainer 3, and in a state before they engage with the cable retainer 3, the bent portions upwardly project from the rear ends of the lower shell 5*b*. The four bent portions 76 are aligned along the aligning direction of the terminals 2. When the lower shell 5*b* is attached to the housing 4, the four bent portions 76 penetrate the four holes 73*a* formed in the bottom of the concave portion 73 of the housing 4.

The two latch pieces 77 engage with the opposing connector 100 when the connector 1 is inserted into the opposing connector 100, and extend along the inserting direction of the connector 1 at both ends of the lower shell 5*b*. At the ends on the connector fore side of the latch pieces 77, engaging portions 77*a* that project toward the outside of the connector 1 and have rough triangle shapes are formed. The two latch pieces 77 come into contact with the ends of the projections 74*b* in parallel to the displacing pieces 74. When the projections 74*b* displace inwardly due to elastic deformation of the displacing pieces 74, the projections 74*b* press the latch pieces 77. When the latch pieces 77 are pressed by the projections 74*b*, the latch pieces 77 displace toward the inner side of the housing 4. According to inward displacement of the latch pieces 77, the engaging portions 77*a* also displace inwardly, so that the engagement between the opposing connector 100 and the latch pieces 77 can be released.

Figure 4A:
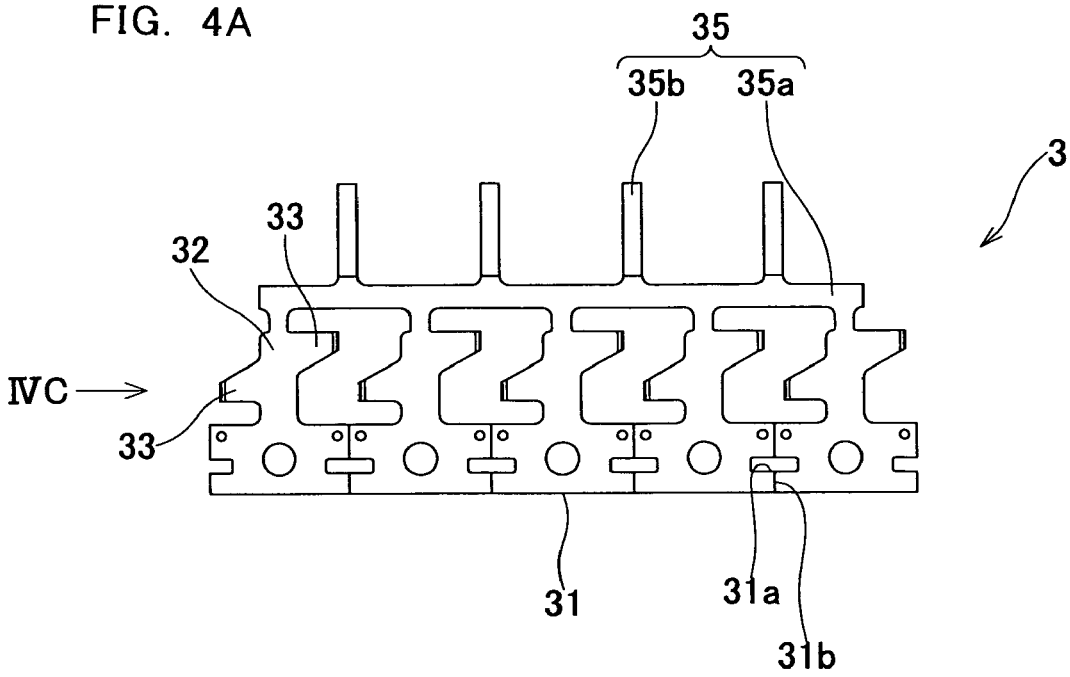
FIG. 4A is a view of the cable retainer shown in FIG. 2 from above.
Figure 4B:
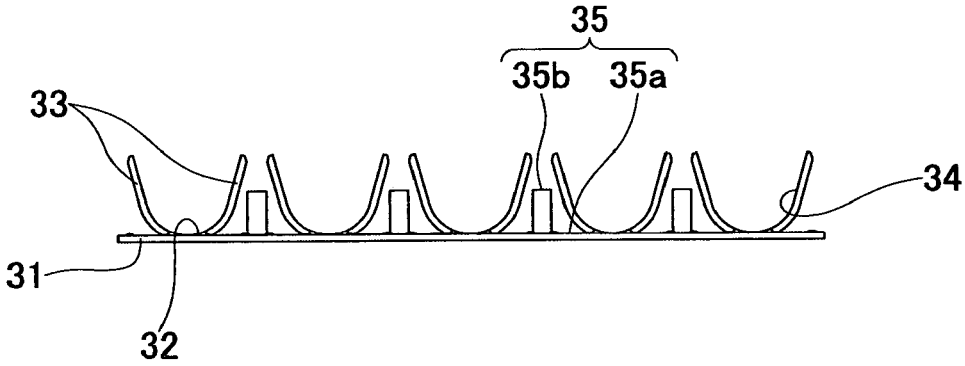
FIG. 4B is a front view of the cable retainer shown in FIG. 2.
Figure 4C:
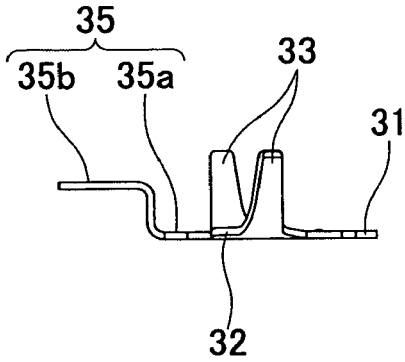
FIG. 4C is a view of the cable retainer shown in FIG. 2 from the arrow IVC of FIG. 4A.

Next, the cable retainer is described in detail with reference to FIG. 4A, FIG. 4B, and FIG. 4C. FIG. 4A is a view of the cable retainer 3 before retaining the cables 50*a* through 50*e* from above. FIG. 4B is a front view of the cable retainer 3 before retaining the cables 50*a* through 50*e*. FIG. 4C is a view of the cable retainer 3 from the arrow IVC of FIG. 4A. As shown in FIG. 2 and FIG. 4, the cable retainer 3 is formed by integral molding of one metal thin plate, and includes a thin plate (main part) 31, five projections (first projections) 32, and a ground part (second projection) 35.

The thin plate 31 is a plate-shaped member extending in one direction. In the thin plate 31, four holes 31*a* that extend along the extending direction of the thin plate 31 and align along the extending direction of the thin plate 31 are formed. When the cable retainer 3 is attached to the housing 4 attached with the lower shell 5*b*, the bent portions 76 penetrate the holes 31*a*. By caulking the bent portions 76 penetrating the holes 31 toward the front end of the connector, the bent portions 76 and the cable retainer 3 are engaged with each other and electrically connected to each other. On the thin plate 31, four grooves 31*b* are formed along the width direction of the thin plate 31 at the centers of the holes 31*a*. The thin plate 31 is easily cut along the grooves 31*b*.

Projections 32 project along the width direction from one end in the width direction of the thin plate 31, and align in a row along the extending direction of the thin plate 31. The projections 32 have caulking portions 33 that project orthogonally to the extending direction from both ends of the width direction so as not to face each other. As shown in FIG. 4B, one projection 32 and two caulking portions 33 projecting from this projection 32 form a curved portion 34 that is shaped into a semicircle when it is viewed from a position in front of the connector. The two caulking portions 33 can clip the cables 50*a* thorough 50*d* disposed on the inner surfaces of the curved portions 34 between the caulking portions and the projections 32 by being plastically deformed by caulking.

The ground part 35 projects along the extending direction of the projections 32 from the ends of the projections 32, and their ends are disposed on the terminals (second terminals) 2 that serve as ground electrodes when they are attached to the housing 4. As shown in FIG. 4A, the ground part 35 has a joint 35*a* and four connect portions 35*b*. The joint 35*a* is formed by integrating its longitudinal side and the ends of the five projections 32 while extending in the aligning direction of the projections 32.

As shown in FIG. 4C, the connect portions 35*b* extend in a direction orthogonal to the flat surfaces of the projections 32 from the side opposite the side integrated with the projections 32 in the joint 35*a*, and further project in a direction of separating from the joint 35*a* along the extending direction of the projections 32 from their extending tip ends. As shown in FIG. 4B, the connect portions 35*b* are disposed between the projections 32 when viewed from a position in front of the connector. As shown in FIG. 4A, both sides of the portion where the joint 35*a* is integrated with the projections 32 are notched so that the joint 35*a* and the projections 32 are easily separated. The joint 35*a* can also be cut at an arbitrary position.

The cable retainer 3 is only required to have curved portions 34 corresponding to the number of cables to be retained. The cable retainer 3 is primarily a long member which has a number of curved portions 34, that is, substantially, a long member to which a number of cable retainers are joined, and are used by being cut along the grooves 31*b* so as to have curved portions 34 corresponding to the number of cables to be retained. In this embodiment, the cable retainer 3 retains five cables 50*a* through 50*e*, so that the cable retainer 3 is formed as an assembly of five cable retainers having curved portions 34. The ground part 35 is shared by the individual cable retainers, so that it is also allowed that the number of connect portions 35*b* is arbitrary.

Figure 5:
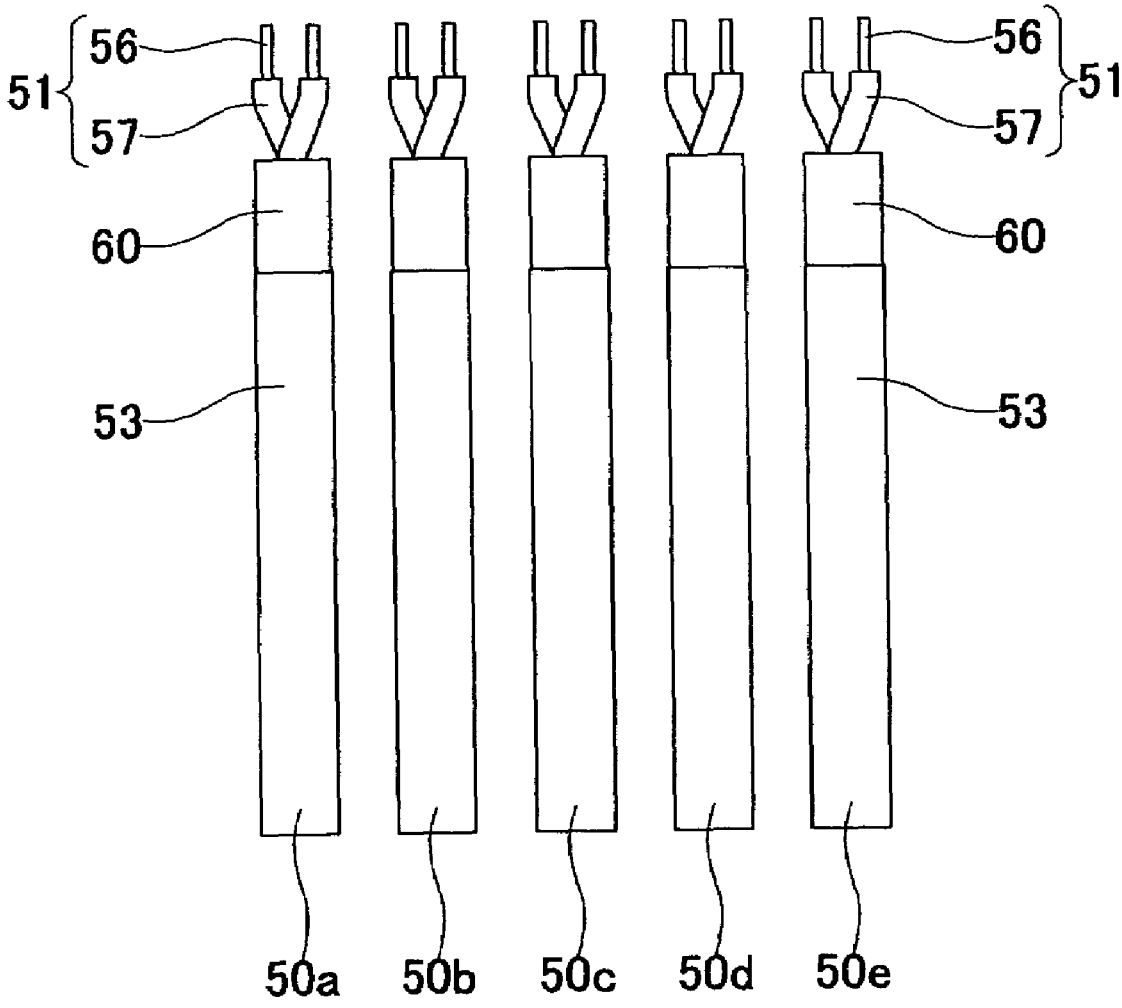
FIG. 5 is a view for explaining assembling procedures of the connector shown in FIG. 1.
Figure 6:
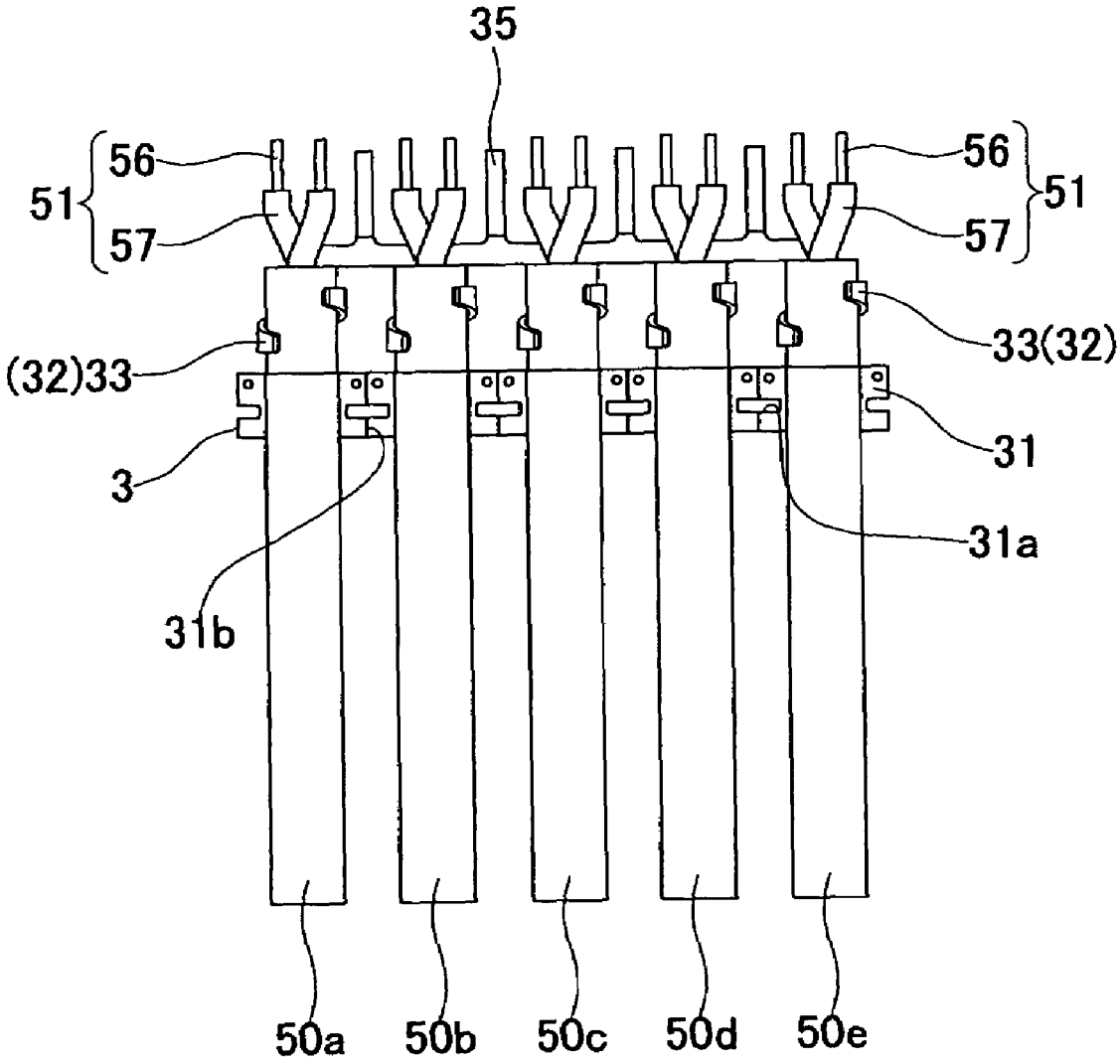
FIG. 6 is a view for explaining assembling procedures of the connector shown in FIG. 1.

Next, assembling procedures for the connector 1 are described with reference to FIG. 1 and FIG. 5 through FIG. 7. FIG. 5 through FIG. 7 are drawings for explaining the assembling procedures for the connector 1. As shown in FIG. 5, cables 50*a* through 50*e* each having a shield material 60 and a core 56 that include exposed ends are prepared.

Next, as shown in FIG. 6, a cable retainer 3 having five curved portions 34 is prepared, and the exposed ground materials 60 of the cables 50*a* through 50*e* are disposed on the inner surfaces of the curved portions 34 in the cable retainer 3. Thereafter, the caulking portions 33 are plastically deformed by caulking so as to clip the cables 50*a* through 50*d* between the caulking portions and the projections 32. In this case, the two cores 56 of each of the cables 50*a* through 50*d* and the connect portions 35*b* of the cable retainer 3 are alternately aligned in a row along the aligning direction of the cables 50*a* through 50*d*.

Then, as shown in FIG. 7, the cable retainer 3 that retains the cables 50*a* through 50*d* are disposed in the concave portions 72 and the concave portion 73 of the housing 4 attached with the lower shell 5*b*. At this point, the ends of the bent portions 76 of the lower shell 5*b* penetrate the holes 73*a* formed in the bottoms of the concave portions 73 and project vertically, and the bent portions 76 projecting from the bottoms of the concave portions 73 further penetrate the holes 31*a* of the thin plate 31 of the cable retainer 3. Then, the bent portions 76 penetrating the holes 31*a* are caulked toward the front end of the connector, whereby the bent portions 76 and the thin plate 31 are engaged with each other and electrically connected to each other. Namely, the cable retainer 3 and the lower shell 5*b* are electrically connected to each other. At this point, the ends of the cores 56 exposed from the cables 50*a* through 50*e* and the ends of the connect portions 35*b* of the cable retainer 3 face the corresponding terminals 2, respectively. The ends of the cores and the ends of the connect portions 35*b* of the cable retainer 3 are solder-joined to the facing terminals 2.

Last, the lower shell 5*b* is combined with the upper shell 5*a* to form the shell 5 (see FIG. 1). At this point, the upper shell 5*a* and the lower shell 5*b* are electrically connected, and the shell 5 encloses the ends of the cores 56 exposed from the cables 50*a* through 50*e* and the joints between the ends of the connect portions 35*b* of the cable retainer 3 and the terminals 2.

According to the embodiment described above, when the cable retainer 3 is attached to the housing 4 while retaining the shield materials 60 exposed from the cables 50*a* through 50*e*, by a simple method in which the ends of the connect portions 35*b* of the cable retainer 3 and the corresponding terminals 2 are solder-joined to each other, the shield materials 60 and the corresponding terminals 2 can be electrically connected. Therefore, the troublesome wiring operations for electrically connecting the shield materials 60 and the terminals 2 become unnecessary. Thereby, the manufacturing costs of the harness including the connector 1 and the cables 50*a* through 50*e* can be reduced.

In addition, in this embodiment, the caulking portions 33 are plastically deformed by caulking, so that various types of cables with different diameters can be securely retained by the curved portions 34.

Furthermore, according to this embodiment, the shell 5 encloses the ends of the cores 56 exposed from the cables 50*a* through 50*e* and the joints between the ends of the connect portions 35*b* of the cable retainer 3 and the terminals 2, so that the portions exposed from the shield materials 60 can be shielded.

In addition, according to the embodiment, the cable retainer 3 substantially functions as five cable retainers, so that the cable retainer collectively retains the cables 50*a* through 50*e* and electrically connects the shield materials of these cables to the terminals 2.

In addition, in the cable retainer 3, the ground part 35 can easily be separated, so that the cable retainer easily adapts to cables that have no shield materials.

An embodiment of the invention is described above, however, the invention is not limited to the above-described embodiment, and within the scope of the claims for the patent, various design changes are possible. For example, the connector 1 has a conductive shell 5 in the above-described embodiment, however, the invention is not limited to this, and it is also allowed that the shell is not conductive, or no shell is provided.

In the above-described embodiment, in the cable retainer 3, the caulking portions 33 project from both ends in the width direction of the projections 32 so as to be orthogonal to the extending direction and so as not to face each other, however, the invention is not limited thereto, and the forms of the caulking portions are arbitrary as long as the curved portions can retain the cables by being plastically deformed by caulking. For example, the caulking portions may project so as to face each other from the main parts, or may project from only one side of the main parts.

In the above-described embodiment, the ground part 35 is integrated with the ends of the projections 32 at the joint 35*a*, however, the invention is not limited thereto, the ground part 35 and the projections 32 may be connected at arbitrary positions as long as they are electrically connected. For example, it is also possible that the groundpart 35 is integrated with the thin plate 31.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A connector comprising:

a conductive cable retainer including a plate-shaped main part, a first projection projecting from the main part configured to support a cable, and a second projection projecting from the main part or the first projection in a first direction in which the cable extends;

a supporter that supports the cable retainer;

a first terminal that is supported by the supporter, a core of the cable configured to be retained by the cable retainer and configured to connect to the first terminal;

a second terminal that is supported by the supporter, the second projection of the cable retainer being joined to the second terminal; and a conductive shell, wherein the conductive shell includes a first portion being in contact with the cable retainer and a second portion opposed to the first portion so as to surround a joint between the core of the cable and the first terminal upon connection thereof, wherein the first and second terminals are arranged adjacent to each other in a second direction orthogonal to the first direction.

2. The connector according to claim 1, wherein the first projection clip a cable that is disposed on the main part between the first projection and the main part by being plastically deformed by caulking.

3. The connector according to claim 1, wherein a plurality of the cable retainers are provided, and the first and second terminals are arranged adjacent to each other in the second direction.

4. The connector according to claim 1, wherein the second projection is separable from the main part or the first projections.

5. The connector according to claim 1, comprising a plurality of the second projections, wherein the first and second projections are alternately arranged along the second direction.

* * * * *